US007927652B2

(12) United States Patent
Wei et al.

(10) Patent No.: US 7,927,652 B2
(45) Date of Patent: Apr. 19, 2011

(54) METHOD FOR MANUFACTURING FIELD EMISSION ELECTRON SOURCE

(75) Inventors: Yang Wei, Beijing (CN); Lin Xiao, Beijing (CN); Feng Zhu, Beijing (CN); Jie Tang, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 812 days.

(21) Appl. No.: 11/973,222

(22) Filed: Oct. 5, 2007

(65) Prior Publication Data

US 2008/0214082 A1 Sep. 4, 2008

(30) Foreign Application Priority Data

Nov. 15, 2006 (CN) ..... 2006 1 0156847

(51) Int. Cl.
*H01J 1/304* (2006.01)
*H01J 1/30* (2006.01)
*H01J 1/00* (2006.01)

(52) U.S. Cl. ..... 427/77; 427/58; 427/64; 427/66; 427/67; 427/123; 427/125; 427/126.1; 427/126.2; 427/180; 427/189; 445/23; 445/35; 445/46; 445/50; 445/51; 313/326; 313/346 R; 313/310; 313/483

(58) Field of Classification Search ..... 427/77, 427/78, 108; 445/51
See application file for complete search history.

(56) References Cited

U.S. PATENT DOCUMENTS

| | | | | |
|---|---|---|---|---|
| 6,033,924 | A | 3/2000 | Pack et al. | |
| 6,409,567 | B1 * | 6/2002 | Amey et al. | 445/50 |
| 2002/0074932 | A1 * | 6/2002 | Bouchard et al. | 313/495 |
| 2003/0127965 | A1 * | 7/2003 | Uemura et al. | 313/495 |
| 2004/0195950 | A1 * | 10/2004 | Ryu et al. | 313/311 |
| 2005/0064167 | A1 * | 3/2005 | Mao et al. | 428/292.1 |
| 2005/0236951 | A1 | 10/2005 | Liu et al. | |
| 2005/0255613 | A1 | 11/2005 | Kim | |
| 2006/0009111 | A1 * | 1/2006 | Cheng et al. | 445/51 |
| 2007/0096617 | A1 * | 5/2007 | Hwang | 313/310 |

FOREIGN PATENT DOCUMENTS

| | | |
|---|---|---|
| JP | 2001-130904 | 5/2001 |
| JP | 2002-170480 | 6/2002 |
| JP | 2004-179026 | 6/2004 |
| JP | 2004-214164 | 7/2004 |

(Continued)

OTHER PUBLICATIONS

Lam et al., "A Review of Carbon Nanotube Toxicity and Assessment of Potential Occupational and Environmental Health Risks", Critical Reviews in Toxicology, vol. 26 Issue 3, (Mar. 2006).*

(Continued)

*Primary Examiner* — Timothy H Meeks
*Assistant Examiner* — Lisha Jiang
(74) *Attorney, Agent, or Firm* — Jeffrey T. Knapp

(57) ABSTRACT

A method for manufacturing a field emission electron source, the method comprising the steps of: preparing a substrate, a carbon nanotubes slurry, and a conductive slurry; applying a conductive slurry layer onto the substrate; applying a layer of carbon nanotubes slurry onto the conductive slurry layer; and solidifying the substrate under a temperature of 300 to 600 degrees centigrade so as to form the field emission electron source.

12 Claims, 4 Drawing Sheets

FOREIGN PATENT DOCUMENTS

| | | |
|---|---|---|
| JP | 2005-222952 | 8/2005 |
| JP | 2007-103313 | 4/2007 |
| TW | 480537 | 3/2002 |
| TW | I231518 | 4/2005 |
| TW | I240295 | 9/2005 |
| TW | I255792 | 6/2006 |

OTHER PUBLICATIONS

Mohring et al., Techniques in Organic Chemistry, W.H. Freeman, 2nd Ed., (Jan. 1, 2006).*

"MSDS: Silver", Sigma Aldrich, (1993-2010).*

"MSDS: Silicon Dioxide", Sigma Aldrich, (1989-2010).*

Wei et al., "Cold Linear Cathodes with Carbon Nanotube Emitters and Their Application in Luminescent Tubes", Nanotechnology, vol. 18, (2007).*

Kim et al., "Nanodispersion of Single-Walled Carbon Nanotubes Using Dichloroethane", Journal of Nanoscience and Nanotechnology, (2005), pp. 1055-1059.*

* cited by examiner

METHOD FOR MANUFACTURING FIELD EMISSION ELECTRON SOURCE

BACKGROUND

1. Field of the Invention

The present invention relates to methods for manufacturing field emission electron source and, more particularly, to a method for manufacturing a carbon nanotube (CNT) field emission electron source.

2. Description of Related Art

It has been well known that carbon nanotubes (CNTs) are ideal for use as electron emitters of field emission electron source. Generally, a typical CNT field emission electron source includes a substrate and CNTs as electron-emitters formed on the substrate. Methods for forming CNTs on the substrate include mechanical methods and in-situ growth methods.

In the mechanical method, CNTs are preformed and then moved into contact with the substrate using atomic force microscopy. The CNTs are attached to the substrate using conductive adhesive. The advantage of the mechanical method is that the process is simple. However, since CNTs are so small, they are not easy to manipulate and efficiency is low. Also, the CNTs are attached to the substrate by adhesive and this tends to decrease the field emission of the CNTs.

In the in-situ growth method a catalyst layer is first applied onto the substrate and CNTs are formed using a process selected from the group consisting of CVD (chemical vapor deposition), arc discharge, and laser evaporation. In-situ growth creates a high level of contact between the CNTs and the substrate, however, bond strength of the CNTs to the substrate is weak. When the field emission electron source is used, the CNTs may easily become detached from the substrate, and the field emission electron source may be damaged as a result.

What is needed, therefore, is to provide a method for manufacturing CNT field emission electron sources in which the above problems are eliminated or at least alleviated.

SUMMARY

In a present embodiment, a method for manufacturing a field emission electron source, the method comprising the steps of: providing a substrate, a carbon nanotubes slurry and a conductive slurry; applying the conductive slurry layer onto the substrate; applying the carbon nanotubes slurry layer onto the conductive slurry layer; and solidifying the substrate at a temperature of 300 to 600 degrees centigrade so as to form the field emission electron source.

Advantages and novel features will become more apparent from the following detailed description of the present method for manufacturing field emission electron source, when taken in conjunction with the accompanying drawings.

BRIEF DESCRIPTION OF THE DRAWINGS

Many aspects of the present method for manufacturing field emission electron sources can be better understood with reference to the following drawings. The components in the drawings are not necessarily drawn to scale, the emphasis instead being placed upon clearly illustrating the principles of the present method for manufacturing field emission electron sources. Moreover, in the drawings, like reference numerals designate corresponding parts throughout the several views.

Figure 1:
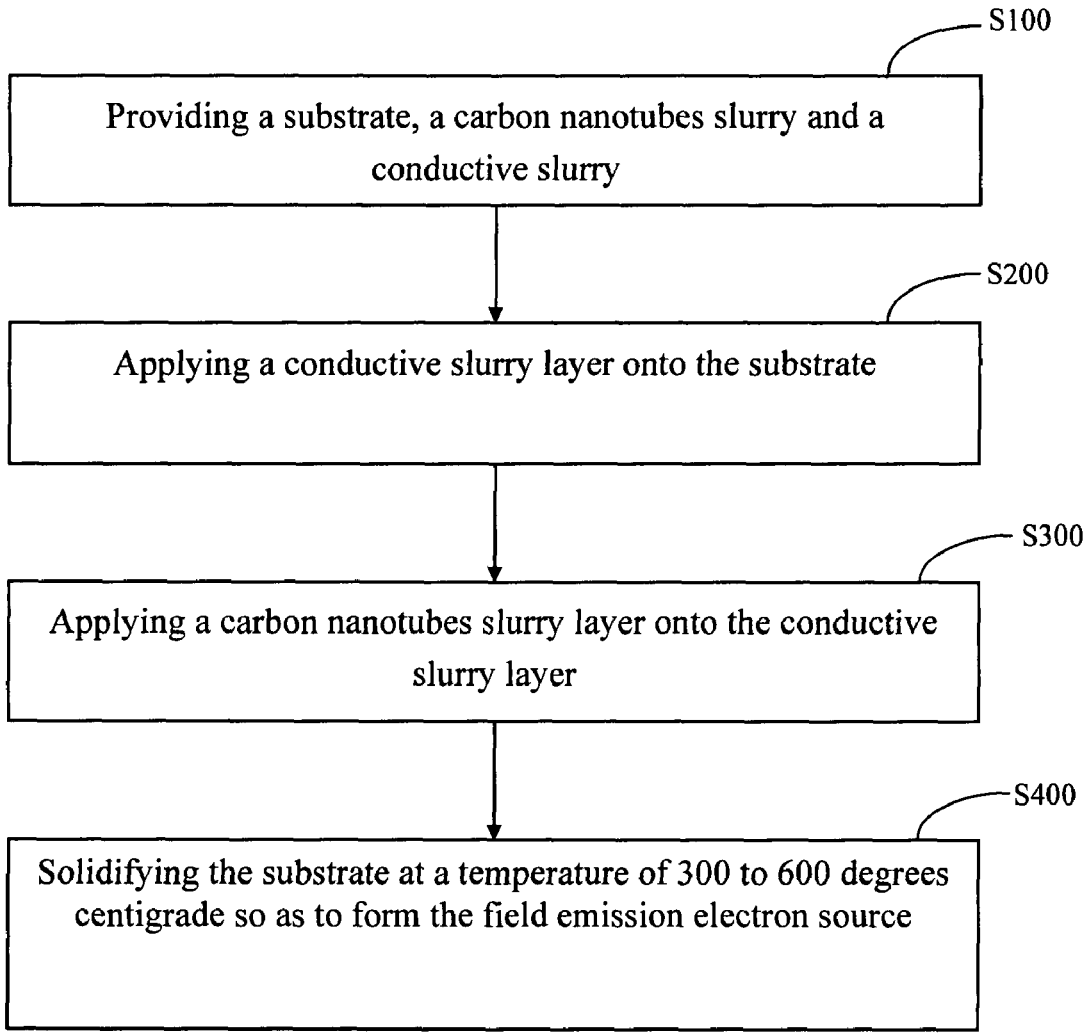
FIG. 1 is a flow chart of a method for manufacturing field emission electron sources according to a present embodiment.

Corresponding reference characters indicate corresponding parts throughout the drawings. The exemplifications shown herein illustrate at least one present embodiment of the present method for manufacturing field emission electron source, in one form, and such exemplifications are not to be construed as limiting the scope of the invention in any manner.

DETAILED DESCRIPTION OF THE INVENTION

Reference will now be made to the drawings to describe present embodiments of the method for manufacturing field emission electron source.

Referring to FIG. 1, a method for manufacturing field emission electron source according to a present embodiment is shown. The method includes the steps of: providing a substrate, a carbon nanotubes slurry and a conductive slurry, shown as step S100; applying the conductive slurry onto the substrate to form a conductive slurry layer, shown as step S200; applying the carbon nanotubes slurry onto the conductive slurry layer so as to form a carbon nanotubes slurry layer, shown as step S300; and solidifying the substrate at a temperature of 300 to 600 degrees centigrade so as to form the field emission electron source, shown as step S400.

Further in step S100, material of the substrate is selected from the group consisting of metal, doped semi-conductors, carbides, conductive oxides and nitrides. The substrate can be shaped as needed. For example, if the field emission electron source is to be used in planar display devices, the substrate can be plate-shaped and if the field emission electron source is to be used in lighting tubes, the substrate can be rod-shaped etc.

Figure 2:
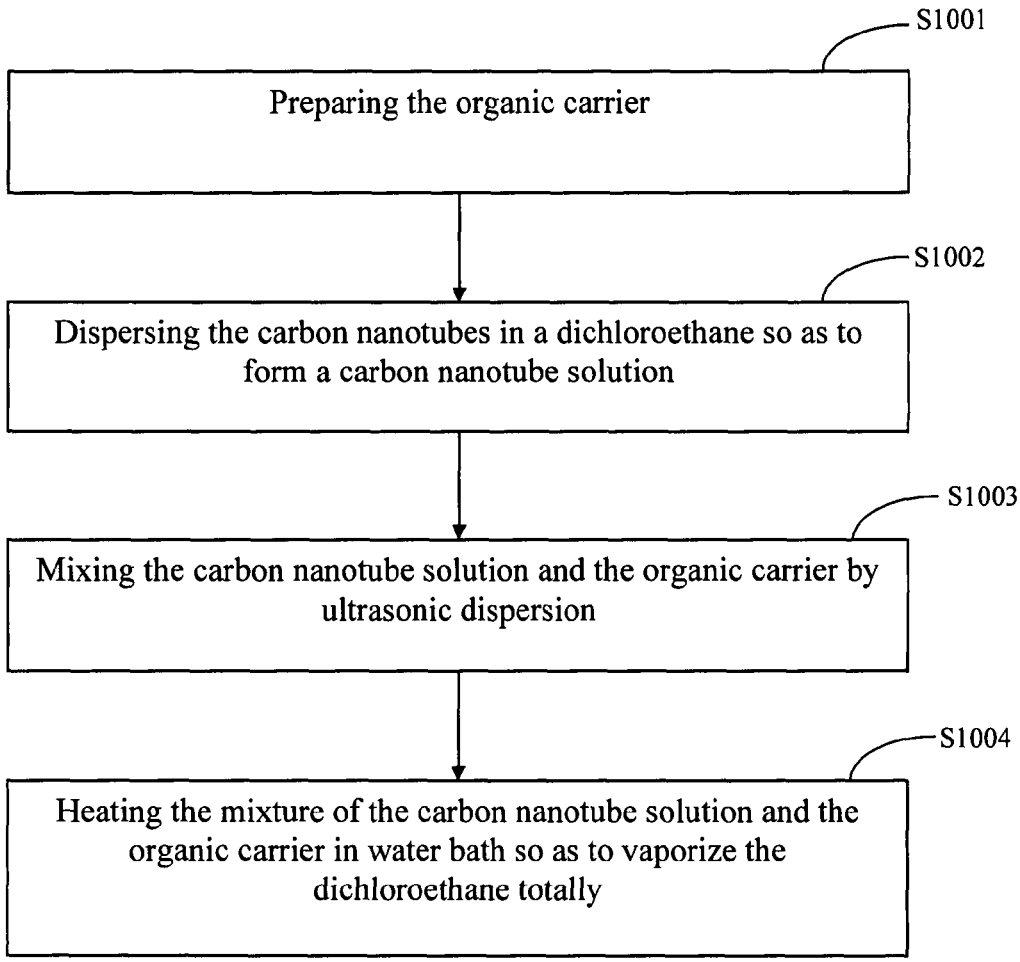
FIG. 2 is a flow chart of a method for manufacturing carbon nanotubes slurry according to the present embodiment.

The carbon nanotubes slurry typically includes organic carrier and carbon nanotubes suspended in the organic carrier. Additionally, glass particles and conductive particles can be added to the carbon nanotubes slurry. FIG. 2 shows a method for preparing the carbon nanotubes slurry, the method includes the steps of: preparing the organic carrier, shown as step S1001; dispersing the carbon nanotubes in a dichloroethane so as to form a carbon nanotube solution, shown as step S1002; mixing the carbon nanotube solution and the organic carrier by ultrasonic dispersion, shown as step S1003; heating the mixture of the carbon nanotube solution and the organic carrier in water bath so as to vaporize the dichloroethane totally, shown as step S1004. Further details of each step are given below.

In step S1001, the organic carrier includes terpineol, dibutyl phthalate, and ethyl cellulose. A method for preparing the organic carrier includes the steps of: dissolving ethyl cellulose and dibutyl phthalate into terpilenol under a temperature of 80 to 110 degrees centigrade, preferably 100 degrees centigrade of oil bath; and stirring ethyl cellulose, dibutyl phthalate and terpilenol for 10 to 25 hours, preferably 24 hours.

The terpineol acts as a solvent, the dibutyl phthalate acts as a plasticizer, and the ethyl cellulose acts as a stabilizer. Preferably, percentages of weights of ingredients of the organic carrier are about 90% of terpilenol, about 5% of ethyl cellulose, and about 5% of dibutyl phthalate.

In step S1002, the carbon nanotubes are manufactured by a process selected from the group consisting of CVD (chemical vapor deposition), arc discharge, and laser evaporation. A preferred length of the carbon nanotubes should be in the range from 1 to 100 microns, and a preferred diameter of the carbon nanotubes should be in the range from 1 to 100 nanometers. A ratio of carbon nanotubes to dichloroethane is that every two grams of carbon nanotubes to 500 milliliters of dichloroethane. The dispersing step includes a crusher-dispersing step and then an ultrasonic-dispersing step. Crusher-dispersing should take from about 5 to 30 minutes, and should preferably be about 20 minutes, and ultrasonic-dispersing should take about 10 to 40 minutes, and preferably about 30 minutes.

Further, after the dispersing step, a screen mesh is used to filter the carbon nanotube solution so that desirable carbon nanotubes can be collected. The number of sieve mesh in the screen mesh should be about 400.

In step S1003, a weight ratio of carbon nanotubes to organic carrier is 15 to 1 and the duration of ultrasonic dispersion is 30 minutes.

In step S1004, a temperature for the heating step in water bath is preferably 90° C. so as to vaporize the dichloroethane totally.

The conductive slurry includes glass particles and conductive particles. The glass particles are low-melting-point glass particles with a melting point in the range from 350 to 600° C. and a diameter in the range from 10 to 100 nanometers. A diameter of the conductive particles is in the range from 0.1 to 10 microns. The conductive particles may be metallic particles or indium-tin-oxide (ITO) particles. A method for manufacturing the conductive slurry includes the steps of totally mixing the glass particles and the conductive particles in organic carrier. A duration for the mixing step can be 3 to 5 hours at a temperature of 60 to 80° C. The organic carrier consists of terpineol as a solvent, dibutyl phthalate as a plasticizer, and ethyl cellulose as a stabilizer. Further, for better dispersion of the conductive slurry, an extra ultrasonic-dispersing step can be performed.

In step S200, the coating steps are performed under conditions wherein the concentration of airborne particulates is less than less than 1000 mg/m$^3$. Preferably, after coating the conductive slurry layer on the substrate, hot airflow drives the conductive slurry layer to dry the conductive slurry layer. A conductive layer is formed on the substrate, and a thickness of the conductive layer can be several microns to several tens of microns.

In step S300, the coating steps are performed in conditions where particulate concentration is less than 1000 mg/m$^3$. Preferably, after coating carbon nanotubes slurry layer on the conductive slurry layer, the carbon nanotubes slurry layer is heated to form an electron-emitting layer on the conductive layer.

In step S400, the solidifying step includes two stages: a baking stage and a sintering stage. The baking stage is to vaporize the organic carrier totally in the conductive slurry and the carbon nanotubes slurry. The sintering stage involves melting the glass particles so as to make the conductive particles and the carbon nanotubes stick to both the substrate and the conductive layer.

To prevent oxidation reaction, the solidifying step is performed under a vacuum environment. Alternatively, the environment may be an inert-gas environment or a nitrogen environment. The carbon nanotubes are electrically connected to the substrate via the conductive particles. Moreover, the melted glass changes a coefficient of heat expansion of the field emission electron source to avoid cracking of the formed conductive layer and the formed electron-emitting layer.

The solidifying step includes the steps of: heating up to a temperature of 320° C. and keeping the temperature of 320° C. for 20 minutes; heating the temperature up to 430° C.; keeping the temperature of 430° C. for 30 minutes; then cooling down to room temperature.

Figure 3:
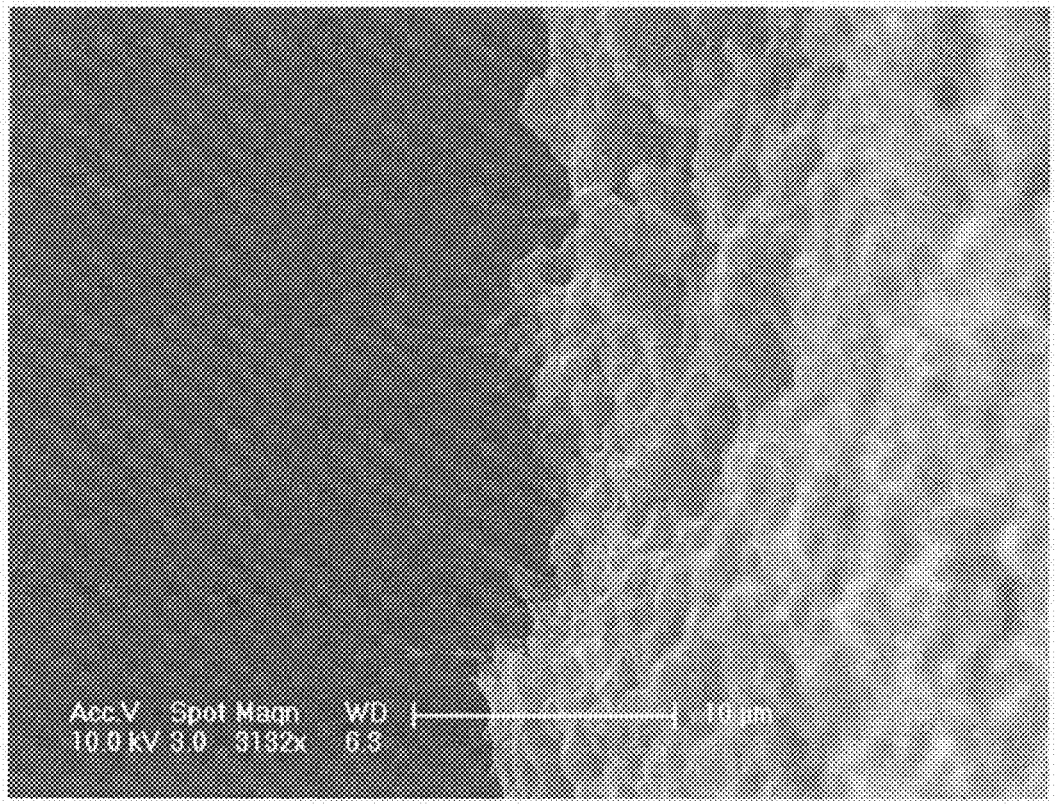
FIG. 3 is a picture taken from a scanning electron microscope of a field emission electron source manufactured by the method according to the present embodiment.

To enhance a field-emission characteristic of the field emission electron source, after the solidifying step, a step of rubbing an emitting surface of the field emission electron source so as to remove loose carbon nanotubes from the field emission electron source can be included. The remaining carbon nanotubes are firmly fixed to the conductive layer and are approximately perpendicular to the substrate as shown in FIG. 3. The sparse and stand-up carbon nanotubes are effective to reduce a field shielding between the carbon nanotubes. This improves the field-emission characteristic of the field emission electron source. Alternatively, a step of using an adhesive tape to modify a surface of the field emission source can also be used to improve the field-emission characteristic of the field emission electron source.

A test for the field-emission characteristic of the field emission electron source is performed. The field emission electron source includes a nickel rod with a diameter of about 300 microns and a length of about 10 centimeters. A carbon nanotubes electron-emitting layer is formed on a surface of the nickel rod. Each end of the nickel rod is fixed onto each end of a glass tube. A diameter of the glass tube is about 25 millimeters and a length of the glass tube is about 10 centimeters. An inner wall of the glass tube is provided with a transparent conductive layer and a fluorescent layer.

Figure 4:
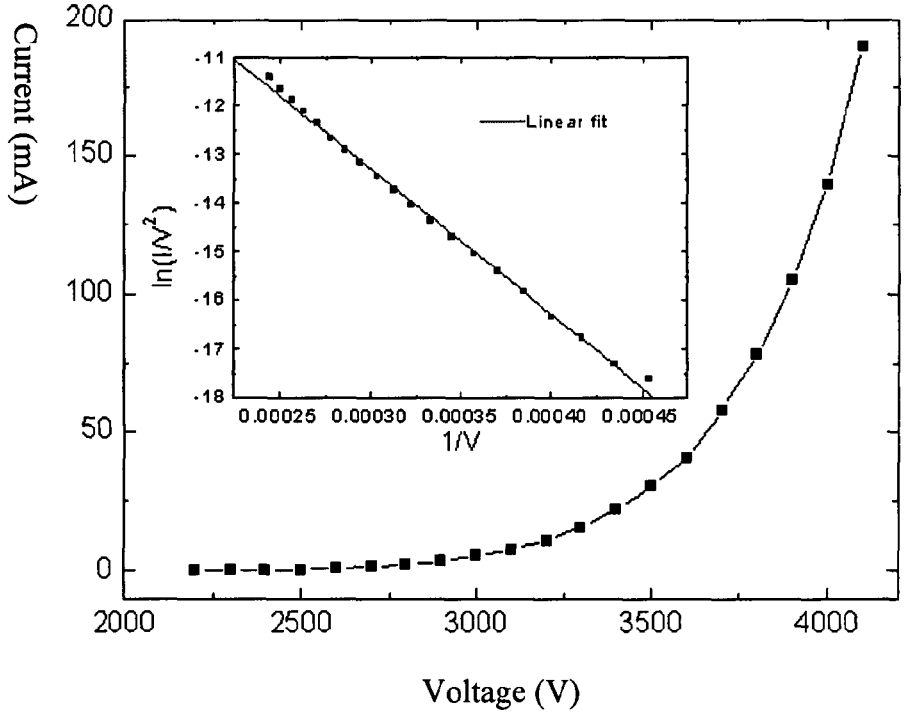
FIG. 4 is a field-emission characteristic graph of the field emission electron source manufactured by the method according to the present embodiment.

Referring to FIG. 4, a resultant voltage-current curve of the testing is shown. A current of the field emission source can be 190 milliamperes (mA) with a potential difference of 4100 voltages. A corresponding current density is 200 mA/cm$^2$, which indicates good field-emission for the field emission electron source.

Since the carbon nanotubes are attached to the substrate by slurry, a good contact and strong bond are maintained between the conductive layer and the carbon nanotubes. Further, the field-emission characteristic of the field emission electron source manufactured by the method of the present invention is good.

It is to be understood that the above-described embodiment is intended to illustrate rather than limit the invention. Variations may be made to the embodiment without departing from the spirit of the invention as claimed. The above-described embodiments are intended to illustrate the scope of the invention and not restrict the scope of the invention.

What is claimed is:

1. A method for manufacturing a field emission electron source, the method comprising the steps of:

providing a substrate, a carbon nanotubes slurry and a conductive slurry;

applying the conductive slurry onto the substrate to form a conductive slurry layer;

applying the carbon nanotubes slurry onto the conductive slurry layer to form a carbon nanotubes slurry layer; and solidifying the substrate at a temperature of 300 to 600 degrees centigrade so as to form the field emission electron source;

wherein the carbon nanotubes slurry comprises an organic carrier and carbon nanotubes suspended in the organic carrier, and a length of the carbon nanotubes is in the range from 1 to 100 microns, and a diameter of the carbon nanotubes is in the range from 1 to 100 nanometers;

wherein the step of providing the carbon nanotubes slurry comprises:

preparing the organic carrier, the organic carrier comprising terpineol, dibutyl phthalate, and ethyl cellulose;

dispersing the carbon nanotubes in a dichloroethane so as to form a carbon nanotube solution;

mixing the carbon nanotube solution and the organic carrier by ultrasonic dispersion; and heating the mixture of the carbon nanotube solution and the organic carrier in water bath so as to vaporize the dichloroethane totally.

2. The method as claimed in claim 1, wherein the step of preparing the organic carrier comprises the steps of:

dissolving ethyl cellulose and dibutyl phthalate into terpilenol at a temperature of 80 to 100 degrees centigrade in an oil bath; and stirring ethyl cellulose, dibutyl phthalate and terpilenol for 10 to 25 hours.

3. The method as claimed in claim 2, wherein percentages of weights of ingredients of the organic carrier are respectively: about 90% of terpilenol, about 5% of ethyl cellulose, and about 5% of dibutyl phthalate.

4. The method as claimed in claim 1, wherein a ratio of carbon nanotubes to dichloroethane is every two grams of carbon nanotubes need 500 milliliters of dichloroethane; a duration of a dispersing step is about 20 minutes; a weight ratio of carbon nanotubes to organic carrier is 15 to 1; a duration of the ultrasonic dispersion is 30 minutes; a temperature for the heating step is 90 degrees centigrade.

5. The method as claimed in claim 1, wherein the conductive slurry comprises glass particles and conductive particles.

6. The method as claimed in claim 5, wherein the glass particles are low-melting-point glass particles with a melting point in the range from 350 to 600 degrees centigrade and a diameter in the range from 10 to 100 nanometers, and a diameter of the conductive particles is in the range from 0.1 to 10 microns.

7. The method as claimed in claim 1, wherein the applying steps are performed with a particulate concentration of less than 1000 $mg/m^3$.

8. The method as claimed in claim 1, wherein the solidifying step is performed under an environment of vacuum or inert gas or nitrogen, and the solidifying step comprises the steps of: keeping a temperature of 320 degrees centigrade for 20 minutes; raising the temperature up to 430 degrees centigrade; keeping the temperature at 430 degrees centigrade for 30 minutes; cooling the temperature down to room temperature.

9. The method as claimed in claim 1, further comprising the step of rubbing a surface of the field emission electron source after the solidifying step so as to remove some loosening carbon nanotubes from the field emission electron source.

10. The method as claimed in claim 1, further comprising the step of using an adhesive tape to modify a surface of the field emission electron source after the solidifying step so as to remove some loosening carbon nanotubes from the field emission electron source.

11. The method as claimed in claim 1, wherein the carbon nanotubes slurry further comprises glass particles and conductive particles.

12. A method for manufacturing a field emission electron source, the method comprising the steps of:

providing a substrate, a carbon nanotubes slurry and a conductive slurry, wherein the conductive slurry is prepared by mixing glass particles and conductive particles in an organic carrier for 3 to 5 hours at a temperature between 60 to 80 degrees centigrade, and the carbon nanotubes slurry comprises an organic carrier and carbon nanotubes suspended in the organic carrier of the carbon nanotubes slurry;

applying the conductive slurry onto the substrate to form a conductive slurry layer;

applying the carbon nanotubes slurry onto the conductive slurry layer to form a nanotubes slurry layer; totally vaporizing the organic carrier of the conductive slurry layer and the organic carrier of the carbon nanotubes slurry; and melting the glass particles to fix the carbon nanotubes and the conductive particles on the substrate;

wherein providing the carbon nanotubes slurry comprises:

preparing the organic carrier of the carbon nanotubes slurry comprising terpineol, dibutyl phthalate, and ethyl cellulosel;

dispersing the carbon nanotubes in a dichloroethane to form a carbon nanotube solution;

mixing the carbon nanotube solution and the organic carrier of the carbon nanotubes slurry by ultrasonic dispersion; and heating the mixture of the carbon nanotube solution and the organic carrier of the carbon nanotubes slurry in a water bath to completely vaporize the dichloroethane.

* * * * *